US007228829B1

(12) United States Patent
Louie

(10) Patent No.: US 7,228,829 B1
(45) Date of Patent: Jun. 12, 2007

(54) CONTINUOUSLY VARIABLE VALVE TIMING DEVICE

(76) Inventor: George Louie, 731 Desmond Ct., Brooklyn, NY (US) 11235

( * ) Notice: Subject to any disclaimer, the term of this patent is extended or adjusted under 35 U.S.C. 154(b) by 64 days.

(21) Appl. No.: 11/286,231

(22) Filed: Nov. 23, 2005

Related U.S. Application Data

(63) Continuation-in-part of application No. 11/054,689, filed on Feb. 8, 2005, now abandoned.

(60) Provisional application No. 60/622,190, filed on Oct. 26, 2004.

(51) Int. Cl.
*F01L 1/34* (2006.01)

(52) U.S. Cl. ..... 123/90.15; 123/90.17; 123/90.31

(58) Field of Classification Search ..... 123/90.15, 123/90.16, 90.17, 90.18, 90.27, 90.31, 90.2, 123/90.39, 90.44, 90.6
See application file for complete search history.

(56) References Cited

U.S. PATENT DOCUMENTS

| | | | |
|---|---|---|---|
| 1,061,098 | A | 5/1913 | McKeen |
| 1,220,124 | A | 3/1917 | Hoffner |
| 1,358,188 | A | 11/1920 | Brewer |
| 1,632,223 | A | 8/1927 | Fey |
| 1,787,717 | A | 1/1931 | Boulet |
| 2,060,580 | A | 11/1936 | Chapelle |
| 2,121,560 | A | 6/1938 | Duncan |
| 2,159,017 | A | 5/1939 | Duncan |
| 2,191,459 | A | 2/1940 | Duncan |
| 2,305,787 | A | 12/1942 | Kales |
| 2,682,260 | A | 6/1954 | Lantz |
| 2,685,281 | A | 8/1954 | MacGregor |
| 2,804,081 | A | 8/1957 | Gamble |
| 2,839,036 | A | 6/1958 | Strang |
| 2,861,557 | A | 11/1958 | Stolte |
| 2,890,594 | A | 6/1959 | Hellmann |
| 2,969,051 | A | 1/1961 | Webster |
| 2,980,089 | A | 4/1961 | Sampietro |
| 3,004,410 | A | 10/1961 | Pierce |
| 3,106,195 | A | 10/1963 | Hanley |
| 3,144,009 | A | 8/1964 | Goodfellow et al. |
| 3,301,010 | A | 1/1967 | Vernick |
| 3,308,797 | A | 3/1967 | Buyetti et al. |
| 3,369,532 | A | 2/1968 | McIlroy |
| 3,401,572 | A | 9/1968 | Bailey |
| 3,481,314 | A | 12/1969 | Le Crenn |
| 3,499,347 | A | 3/1970 | Pearson |

(Continued)

*Primary Examiner*—Ching Chang
(74) *Attorney, Agent, or Firm*—David Pressman

(57) ABSTRACT

A system for continuously varying valve-opening overlap in reciprocating internal combustion engines changes the path of the timing belt (16) that drives the intake valve camshaft (26). An idler wheel (44) mounted on a pivoted arm (48) turns against the timing belt. At low engine speeds, the sprocket wheel idles against the timing belt. At higher engine speeds, increased engine oil pressure causes a hydraulic cylinder (58) to force the sprocket wheel against the timing belt, changing its path. As the path of the belt is changed, the intake valve position is advanced with respect to the position of the crankshaft (12). The exhaust valve position remains the same relative to that of the crankshaft. Thus at above-idle speeds, intake-exhaust valve overlap is present. Since the amount of belt path deviation is related to engine oil pressure, and thus engine speed, valve overlap varies smoothly as a function of engine speed. A tensioner (30) maintains proper belt tensioning at all times.

32 Claims, 6 Drawing Sheets

U.S. PATENT DOCUMENTS 3,502,059 A 3/1970 Davis et al.
3,516,394 A 6/1970 Nichols
3,523,485 A 8/1970 Harrell
3,633,554 A 1/1972 Nakajima et al.
3,721,220 A 3/1973 Garcea
3,800,825 A 4/1974 Seino et al.
3,807,243 A 4/1974 Yada
3,827,413 A 8/1974 Meacham
3,888,216 A 6/1975 Miokovic
3,888,217 A 6/1975 Hisserich
3,945,221 A 3/1976 Miokovic
3,945,355 A 3/1976 Calviac
3,978,829 A 9/1976 Takahashi et al.
4,091,776 A 5/1978 Clemens et al.
4,096,836 A 6/1978 Kopich
4,177,773 A 12/1979 Cribbs
4,231,330 A 11/1980 Garcea
4,302,985 A 12/1981 Natkin
4,305,352 A 12/1981 Oshima et al.
4,421,074 A 12/1983 Garcea et al.
4,463,712 A 8/1984 Stojek et al.
4,481,912 A 11/1984 Stwiorok et al.
4,494,495 A 1/1985 Nakamura et al.
4,494,496 A 1/1985 Nakamura et al.
4,517,934 A 5/1985 Papez
4,535,731 A 8/1985 Banfi
4,545,338 A 10/1985 Allred
4,561,390 A 12/1985 Nakamura et al.
4,580,533 A 4/1986 Oda et al.
4,627,825 A 12/1986 Bruss et al.
4,696,265 A 9/1987 Nohira
4,754,727 A 7/1988 Hampton
4,762,097 A 8/1988 Baker
4,805,566 A 2/1989 Ampferer
4,811,698 A 3/1989 Akasaka et al.
4,841,924 A 6/1989 Hampton et al.
4,856,465 A 8/1989 Denz et al.
4,873,949 A 10/1989 Fujiyoshi et al.
4,889,086 A 12/1989 Scapecchi et al.
4,895,113 A 1/1990 Speier et al.
4,903,650 A 2/1990 Ohlendorf et al.
4,967,701 A 11/1990 Isogai et al.
4,974,560 A 12/1990 King
4,976,229 A 12/1990 Charles
4,986,801 A 1/1991 Ohlendorf et al.
4,993,370 A 2/1991 Hashiyama et al.
4,996,955 A 3/1991 Akasaka et al.
5,002,023 A 3/1991 Butterfield et al.
5,012,773 A 5/1991 Akasaka et al.
5,031,585 A 7/1991 Muir et al.
5,033,327 A 7/1991 Lichti et al.
5,078,647 A 1/1992 Hampton
5,080,055 A 1/1992 Komatsu et al.
5,088,456 A 2/1992 Suga
5,090,366 A 2/1992 Gondek
5,097,804 A 3/1992 Brune et al.
5,111,780 A 5/1992 Hannibal
5,117,784 A 6/1992 Schechter et al.
5,119,691 A 6/1992 Lichti et al.
5,152,263 A 10/1992 Danieli
5,156,119 A 10/1992 Suga
5,159,904 A 11/1992 Ingold
5,161,493 A 11/1992 Ma
5,163,872 A 11/1992 Niemiec et al.
5,172,661 A 12/1992 Brune et al.
5,174,253 A 12/1992 Yamazaki et al.
5,181,485 A 1/1993 Hirose et al.
5,197,421 A 3/1993 Hara
5,203,290 A 4/1993 Tsuruta et al.
5,203,291 A 4/1993 Suga et al.
5,219,313 A 6/1993 Danieli
5,234,088 A 8/1993 Hampton
5,326,321 A 7/1994 Chang
5,327,859 A 7/1994 Pierik et al.
5,329,895 A 7/1994 Nishida et al.
5,333,579 A 8/1994 Hara et al.
5,349,929 A 9/1994 Shimizu et al.
5,355,849 A 10/1994 Schiattino
5,361,736 A 11/1994 Phoenix et al.
5,365,896 A 11/1994 Hara et al.
5,365,898 A 11/1994 Mueller
5,377,638 A 1/1995 Mueller
5,381,764 A 1/1995 Fukuma et al.
5,450,825 A 9/1995 Geyer et al.
5,494,009 A 2/1996 Yamada et al.
5,501,186 A 3/1996 Hara et al.
5,542,383 A 8/1996 Clarke et al.
5,553,573 A 9/1996 Hara et al.
5,557,983 A 9/1996 Hara et al.
5,592,909 A 1/1997 Tsuruta
5,673,659 A 10/1997 Regueiro
5,680,836 A 10/1997 Pierik
5,680,837 A 10/1997 Pierik
5,687,681 A 11/1997 Hara
5,718,196 A 2/1998 Uchiyama et al.
5,803,030 A 9/1998 Cole
5,860,328 A 1/1999 Regueiro
5,979,382 A 11/1999 Heer
6,167,854 B1 1/2001 Regueiro
6,199,522 B1 3/2001 Regueiro
6,216,655 B1 4/2001 Yoshiki et al.
6,640,760 B1 11/2003 Plasencia
6,746,352 B1 6/2004 Poiret et al.
6,763,792 B2 * 7/2004 Okamoto ..... 123/90.31

* cited by examiner

FIG. 7
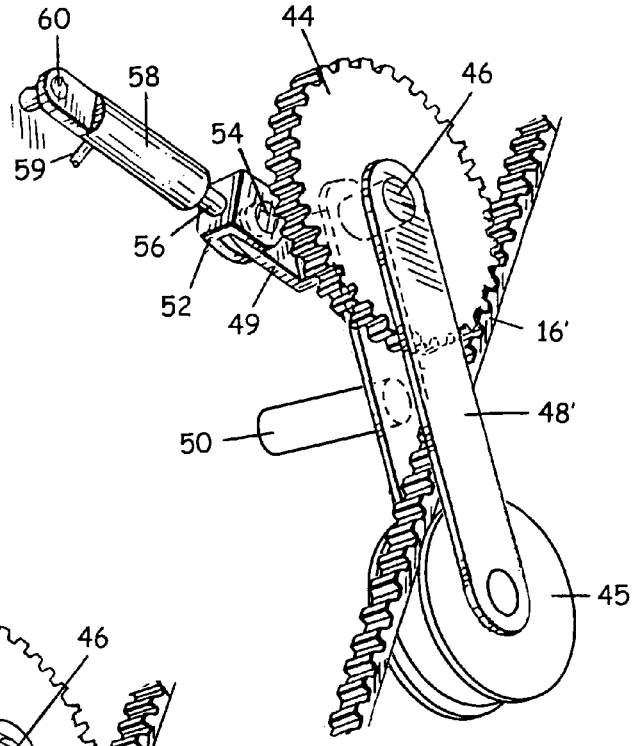
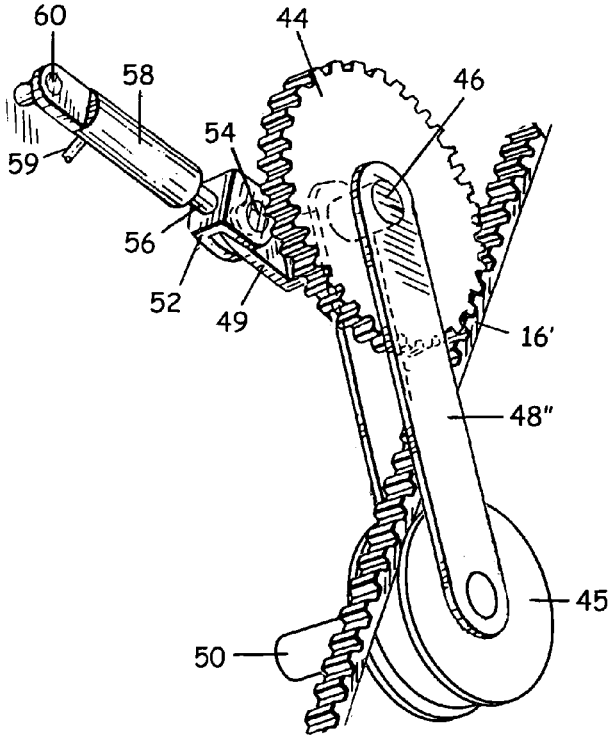
FIG. 8

CONTINUOUSLY VARIABLE VALVE TIMING DEVICE

CROSS-REFERENCE TO RELATED APPLICATIONS

This patent is based upon an application that is a continuation-in-part of parent application Ser. No. 11/054,689, filed 2005 Feb. 8, now abandoned. This parent application claims priority of my provisional patent application, Ser. No. 60/622,190, filed 2004 Oct. 26.

BACKGROUND

Field of Invention

This invention relates generally to internal combustion engines, in particular to automatic valve timing adjustment for such engines.

BACKGROUND

Prior-Art

Reciprocating internal combustion engines are used in most motor vehicles. They have an engine bock with one or more cylinders, each containing a reciprocating piston. Each cylinder has above the piston two openings that are opened and closed by two respective valves: an intake valve to admit a fuel-air mixture in and an exhaust valve to let exhaust gases out. After the fuel-air mixture is admitted, a spark from a spark plug ignites it so that the mixture expands rapidly (explodes) to force the piston down. The piston turns a crankshaft, which is connected through a transmission to the vehicle's wheels so as to controllably propel the vehicle. A linkage comprising a timing belt or chain is connected between the crankshaft and two camshafts so that the crankshaft turns the camshafts. The camshafts have lobes or cams that cam one end of a series of respective rocker arms, causing the rocker arms to reciprocate as the camshaft turns. The other ends of the rocker arms are connected to the valves so as to cause the valves to reciprocate and thereby open and close the openings in the cylinders at the proper times to admit the intake fuel mixture and release the exhaust gases from the cylinders.

In the past, the timing of opening and closing of intake and exhaust valves in such reciprocating internal combustion engines was fixed by the design parameters of the engine. However this compromised engine performance because engine design had to be optimized for use at either low or high rotational speeds (revolutions per minute, RPM).

An engine designed for strong, low-RPM torque will not function optimally at high-RPM. Conversely, an engine designed to deliver strong torque at high-RPM usually provided poor low-RPM performance. In addition to poor power performance, an engine operating at less than optimal efficiency tended to produce excessive amounts of pollutant gases, notably oxides of nitrogen.

A principal difference between these two engine designs (optimized for low or high RPM torque) lies in the timing of the operation of the intake and exhaust valves. This timing is determined by the camshafts, which have a cam lobe for each rocker arm and valve.

The time at which a valve opens or closes with respect to the crankshaft position can be equated to the angular position of each valve. The relative angular relationship between the intake and exhaust valves, or between their respective camshafts, is generally referred to as the "phase angle" or simply "phase" of one shaft with respect to the other. As stated, each lobe on the camshaft bears on one end of a rocker arm. The rocker arm is spring-loaded against the lobe. The rocker arm pivots around a central bearing. The other end of the rocker arm presses on a tappet or spring-loaded valve stem in well-known fashion, thus opening and closing the valve at predetermined times.

As stated, each cylinder usually has two valves, an intake valve and an exhaust valve. Either one valve only can be open at a time, or both valves can be open at certain times. The time during which both valves are open is referred to as valve-opening overlap. If the valves have very little overlap the engine will have a smooth idle and good low-RPM torque, but impaired high-RPM performance. A large amount of overlap allows excellent engine breathing (passage of pre-combustion or post-combustion components) and high performance at high-RPM, but causes a rough idle and poor performance at low RPM.

Prior-art engines frequently included more than one camshaft each for the intake and the exhaust valves, as in double overhead cam designs. However the principles discussed above are the same. In addition, the principles discussed apply to engines with one or more cylinders or more than one intake and one exhaust valve per cylinder.

BACKGROUND

Prior-Art

Varying Overlap with Multiple Intake Camshafts

Honda Motor Company, Ltd. (Honda) of Tokyo, Japan employs an electronic and mechanical system that uses multiple intake valve camshafts. Engines with Honda's "Variable Valve Timing and Lift Electronic Control" system have an extra, secondary intake camshaft with its own rocker arms. When engaged, the secondary camshaft causes the open periods of the intake and exhaust valves to overlap.

At low engine speeds, the secondary camshaft is disengaged. A primary camshaft causes the intake and exhaust valves to operate without overlap. At high engine speeds, the secondary camshaft is engaged, causing operation of the two valves to overlap. While this system works well at low and high engine speeds, it does not smoothly transition at intermediate speeds. Thus engine performance is not optimized at such intermediate speeds.

BACKGROUND

Prior-Art

Varying Overlap with Separate Intake and Exhaust Camshafts

In U.S. Pat. No. 4,231,330 (1980), Garcea teaches a system for timing the opening and closing of intake and exhaust valves in an engine with a separate camshaft for each. His system operates at two extremes. At low RPM, the relative positions of the valves assume one value. At high RPM, the relative positions of the valves assume a second value. The change in relative positions from one value to the other occurs at an intermediate, predetermined engine speed.

As in the Honda system, the valve positions abruptly shift from the low-speed value to the high-speed value, with no smooth transition over a range of engine speeds. Garcea states that while a system providing a smooth transition would be preferable, it would have to be very complicated to ensure that the timing corresponded to the rotational speed with sufficient accuracy. Thus, while his engine operates optimally at both ends of its speed range, no provision is made for mid-range engine speeds.

In U.S. Pat. No. 4,421,074 (1983), Garcea teaches a similar system with two speed thresholds. Below a first predetermined engine speed, the relative positions of the intake and exhaust valves assume a first value. Above the first engine speed and below a second predetermined engine speed, the relative positions of the intake and exhaust valves assume a second value. Above the second engine speed, the relative positions of the intake and exhaust valves assume the first value again.

In his second system, Garcea adjusts valve timing for three engine speed ranges. Again, however, this system makes abrupt changes from one valve timing differential value to another. The transition between the three speed ranges is abrupt so that valve timing is less than optimal at many engine speeds. In this second patent, Garcea repeats his statement that a system that provides a smooth transition would be excessively complicated.

In U.S. Pat. No. 4,463,712 (1984), Stojek et al. teach a system with a helical pinion apparatus mounted on one or two camshafts. In response to control signals derived from engine speed and load, the apparatus causes advancement or retardation of camshaft position. The result is optimal engine performance at all speeds and loads. While this apparatus modulates valve positions optimally, its construction is complex and hence expensive and unreliable.

BACKGROUND

Prior-Art

Gear-less Mechanisms

In U.S. Pat. Nos. 4,494,495 (1985) and 4,494,496 (1985), Nakamura et al. teach two gear-less mechanisms for continuously varying camshaft angles. As with Garcea and Stojek, Nakamura's mechanisms are attached to the end of the camshaft. As in the case of Stojek, Nakamura's system is mechanically complex.

BACKGROUND

Prior-Art

Wedge-activated Mechanism

In U.S. Pat. No. 5,033,327 (1991), Lichti et al. teach a sprocket-driven mechanism attached to the end of a camshaft. This mechanism comprises the sprocket, an assembly of paired wedges, and an associated plunger. In the absence of forcing by the plunger, the wedges assume a rest position. When the wedges are at rest, the camshaft angle remains at a first predetermined value. The plunger is energized in proportion to engine speed by engine oil pressure. When energized, it moves the wedges and changes the phase angle between the sprocket and the camshaft, thus varying engine valve timing. However this system is also complex.

BACKGROUND

Prior-Art

Geared Mechanism

In U.S. Pat. No. 5,361,736 (1994), Phoenix et al. teach a geared mechanism for varying the phase angle of a camshaft with respect to a crankshaft. While this mechanism is workable, it is also mechanically complex.

BACKGROUND

Prior-Art

Quill Shaft Mechanism

Regueiro, in U.S. Pat. No. 6,199,522 (2001), teaches a camshaft phasing mechanism employing a quill shaft formed with helical splines. The actuator assembly is mounted at the front end of the camshaft, while the control unit is mounted at the rear end of the camshaft. Although this system is workable, it is mechanically complex. Additionally, it occupies space at both the front and back ends of the camshaft.

BACKGROUND

Advantages

Accordingly, one advantage of one aspect is to provide an improved method and apparatus for optimizing valve opening times, particularly by varying the phase angle of a camshaft with respect to a crankshaft. Other advantages of one or more aspects are to provide an inexpensive and simple apparatus, which has few moving parts, can be adapted to existing engine designs, provides continuous, precise adjustment of the valve phase angle for all speeds, and which occupies little space at one end of the engine. Additional advantages will become apparent from a consideration of the drawings and ensuing description.

SUMMARY

A method and apparatus provide precise, continuous control over valve overlap in an internal combustion engine. The apparatus is compact and comprises very few components. It is not mounted on the end of the camshaft, as are most prior-art mechanisms. Instead, it is located at the front of the engine. A hydraulic actuator reconfigures the shape of the engine's timing chain or belt to vary valve timing. Adjusting the chain or belt appropriately varies the camshaft position with respect to the crankshaft position, and thus the timing of the valves' opening and closing. This will cause the engine to have better performance at both low and high RPM. The result is a simplified engine with superior power output and lower emissions at all speeds.

DRAWINGS

Figures

FIG. 7 shows an isometric partial view another embodiment where two idler wheels connected by a linkage with a pivot at its center are used to adjust the timing belt.

FIG. 8 shows an isometric partial view another embodiment where two idler wheels connected by a linkage with a pivot at one end are used to adjust the timing belt.

DRAWINGS

Reference Numerals

| | | | |
|---|---|---|---|
| 10 | Sprocket wheel | 12 | Crankshaft |
| 14, 14' | Chain, Belt | 15 | Single Belt |
| 16, 16' | Chain, Belt | 18 | Sprocket wheel |
| 20 | Camshaft | 22 | Lobe |
| 24 | Sprocket wheel | 26 | Camshaft |
| 28 | Lobe | 30 | Tensioner |
| 32 | Bracket | 34 | Roller |
| 35 | Bearing | 36 | Roller |
| 37 | Bearing | 38 | Pivot |
| 40 | Spring | 42 | Footing |
| 44 | Sprocket wheel | 45 | Idle wheel |
| 46 | Bearing | 48 | Arm |
| 49 | Arm extension | 50 | Pivot |
| 52 | Clevis | 54 | Pin |
| 56 | Piston Shaft | 58 | Cylinder |
| 59 | Oil tube | 60 | Pin |
| 64 | Engine block | | |

DESCRIPTION

Preferred Embodiment at Low-And High-RPM Conditions

FIGS. 1-3

Figure 1:
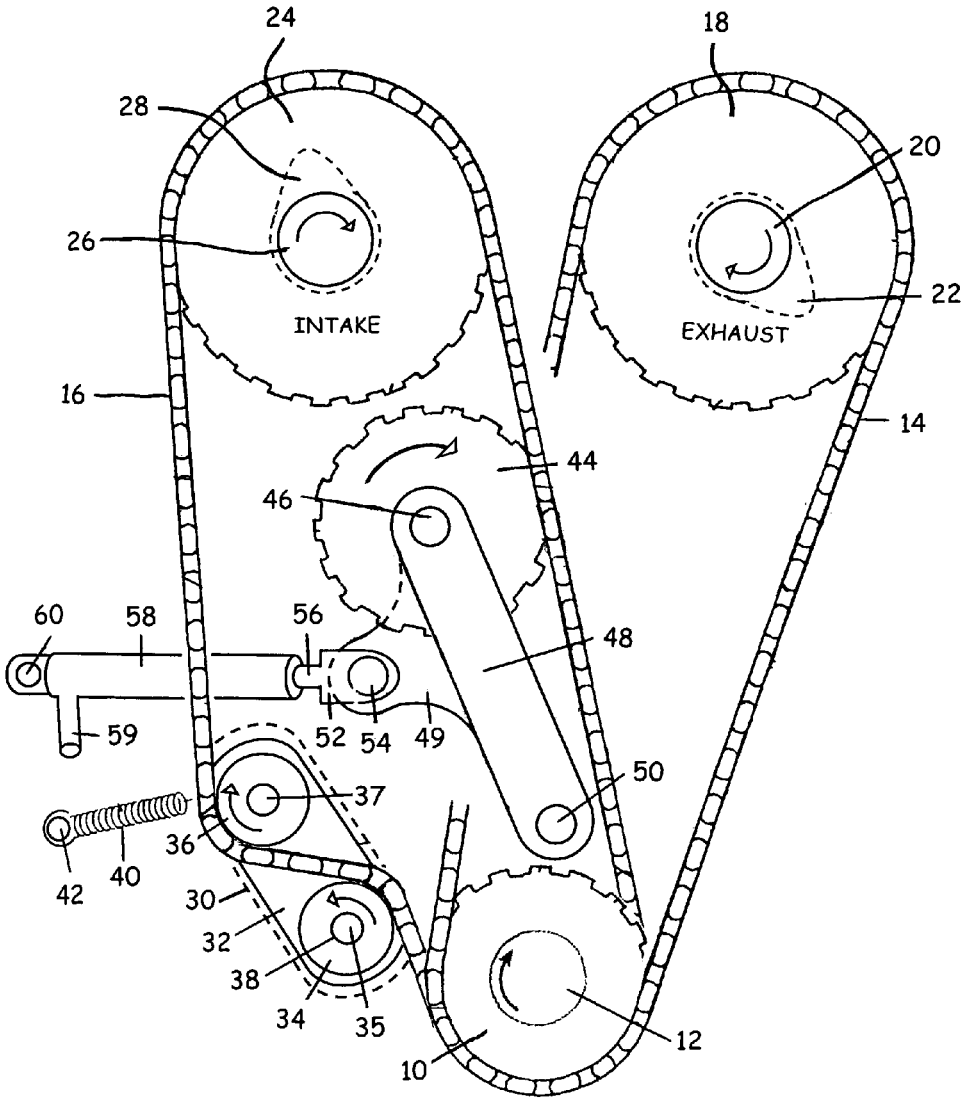
FIG. 1 is a side view of a double overhead cam engine showing a preferred embodiment of the invention. The angular phase of the camshaft lobe is in the retard position, or OFF condition, relative to the crankshaft.
Figure 2:
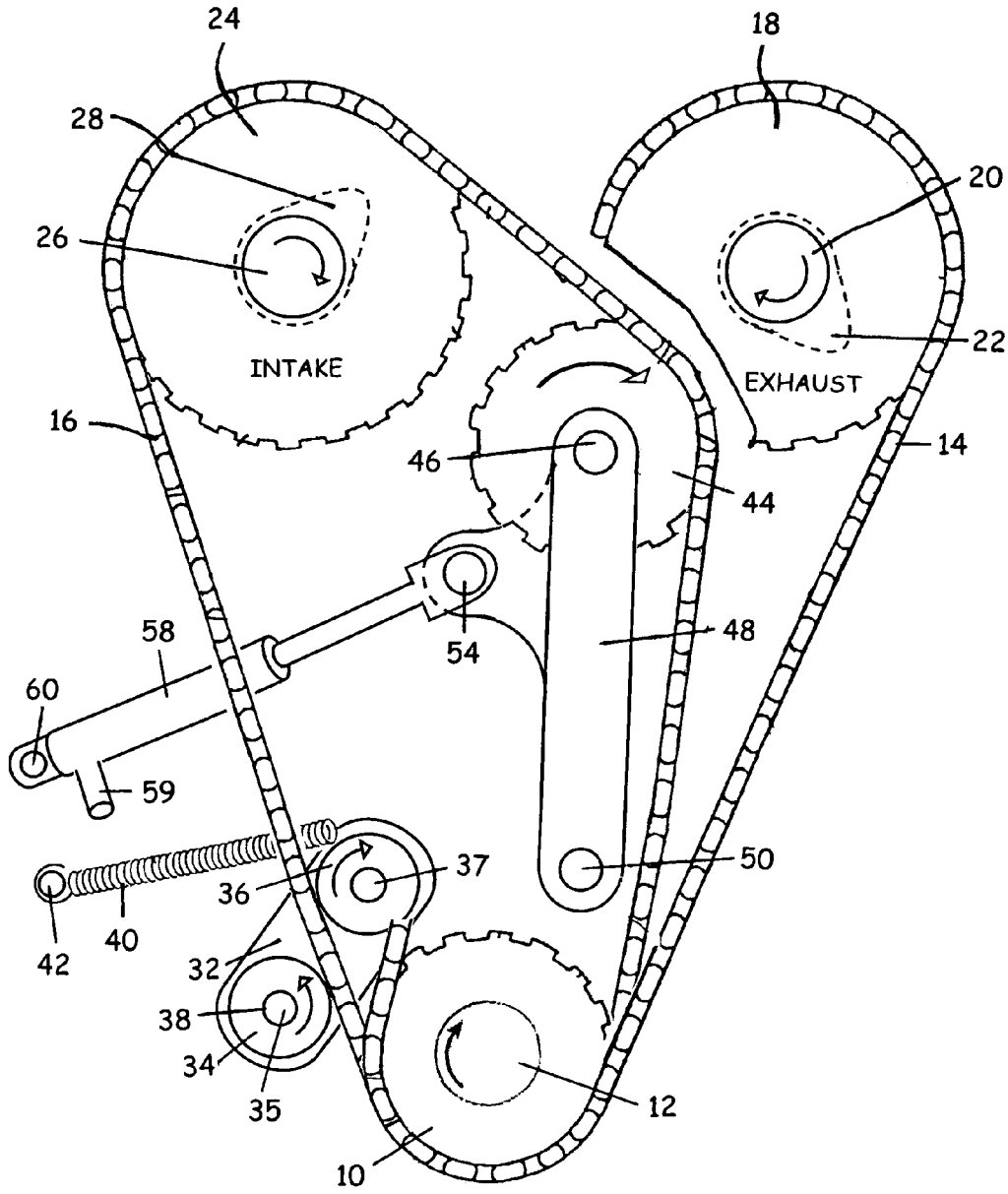
FIG. 2 is the same as FIG. 1, except the angular phase of the camshaft lobe is shown in the advance position, or ON condition, relative to the crankshaft.
Figure 3:
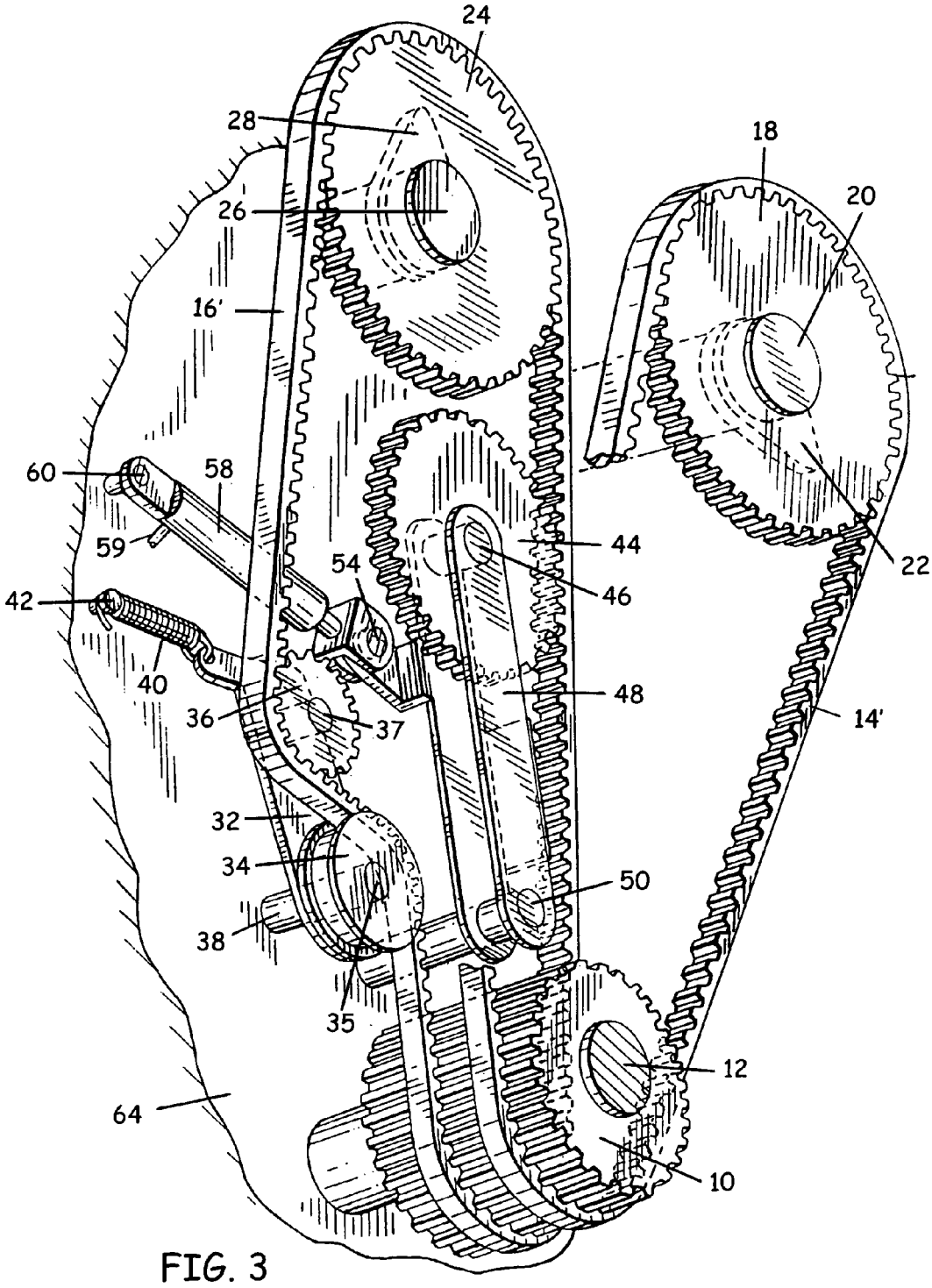
FIG. 3 is an isometric view of FIG. 1, showing timing belts in place of the timing chains in FIGS. 1 and 2.

FIG. 1 shows a diagrammatic view of preferred embodiment of the mechanical timing components of a reciprocating internal combustion engine at idle (low RPM condition) according to the invention. FIG. 3 shows a perspective view of the actual components at the low RPM state. FIG. 2 shows a view similar to FIG. 1, but at a high-RPM condition.

A crankshaft pulley 10 is attached to the engine's crankshaft 12 and has two sprocket wheels or two sets of teeth (rear set not shown) that drive two timing linkages comprising chains or belts (hereinafter belts) 14 and 16. Arrows (FIGS. 1 and 2) show the rotational direction of each rotating part.

Belt 14 is an exhaust timing belt since it engages exhaust sprocket wheel 18, which is fixed to an exhaust-valve camshaft 20. Camshaft 20 has one or more cam lobes 22, each associated with a particular cylinder and piston (not shown) in the engine. As camshaft 20 rotates, lobes 22 cam rocker arms in a reciprocating manner and the rocker arms in turn cause the engine's exhaust valves to open and close in synchrony with their associated piston. (The rocker arms, valves, pistons, and cylinders are not shown but are well known.)

Belt 16 is an intake timing belt since it drives an intake sprocket wheel 24, fixedly attached to an intake camshaft 26. Camshaft 26 has one or more cam lobes 28. As camshaft 26 rotates, lobes 28 engage rocker arms (not shown) which in turn cause the engine's intake valve(s) to open and close, also in synchrony with their associated piston.

Intake belt 16 passes around a tensioner 30 (indicated by a dashed outline in FIG. 1), comprising a bracket 32 and rollers 34 and 36, positioned on opposite sides of belt 16. Belt 16 takes two bends as it passes around rollers 34 and 36. Rollers 34 and 36 rotate on bearings 35 and 37, respectively. Bracket 32 is rotatably mounted on a pivot 38. An extension spring 40 stretches between the end of bracket 32 and a fixed footing 42 and tends to pivot bracket 32 counterclockwise (CCW). Footing 42 is preferably secured to the front of the engine block 64 (FIG. 3). Tensioner 30 keeps belt 16 in tension at all times, thus preventing slippage between belt 16 and its associated sprocket wheels.

A fourth or idler wheel 44 also engages intake belt 16. Wheel 44 has sprockets and rotates on a bearing 46 which is secured to an arm 48. Arm 48 rotatably pivots on a bearing 50, also secured to the front of block 64.

An extension 49 of arm 48 is pivotally attached to a clevis 52 by a pin 54. Clevis 52 is attached to a piston shaft 56, which is mounted in a hydraulic cylinder 58. Cylinder 58 is pivotally attached to block 64 by pin 60. Cylinder 58 is supplied with the engine's lubricating oil (not shown) via a tube 59, which is connected to the engine's oil pump (not shown). The oil pressure increases with increasing engine speed. Thus cylinder 58 urges clevis 52 toward arm 48 with increasing force as engine speed increases.

When sufficient oil pressure is present (high engine speed), the oil pressure in tube 59 and cylinder 58 increases, causing piston shaft 56 and clevis 52 to exert sufficient force to cause arm 48 to pivot in a clockwise (CW) direction around pivot 50. As a result, idler wheel 44 will force the right side of intake belt 16 to deform or bow outwardly, as shown in FIG. 2.

The force of idler wheel 44 on belt 16 will increase the tension in belt 16, causing the portion of belt 16 at tensioner 30 to straighten, as also shown in FIG. 2. This will cause bracket 32 to rotate CW, tensioning and stretching spring 40 even more. Tensioner 30, including spring 40, always maintains tension on belt 16, so that it tends to resist bowing out in response to force from sprocket 44 and urges sprocket 44 back to the left (FIG. 2).

When oil pressure decreases (low engine speed), the pressure in tube 59 and cylinder 58 decreases so that belt 16 will force idler wheel 44 to the left and arm 48 will pivot CCW. The tension on the belt decreases so that spring 40 can pivot bracket 32 CCW. Tensioner 30 with spring 40 will restore the bends in belt 16 as shown in FIG. 1. Tensioner 30 still maintains tension in belt 16.

To recapitulate, at low RPM (FIGS. 1 and 3), belt 16 has lower tension and its right side is straight and its left side has two bends as it passes around wheels 34 and 36 of tensioner 30, with low tension in spring 40. At high RPM, oil pressure increases, causing the pressure in cylinder 58 to increase, forcing piston shaft 56 to extend out, which in turn causes arm 48 to rotate CW and idler wheel 44 to force the right side of belt 16 to bow out and tension in the belt and spring 40 to increase (FIG. 2). This causes the left side of belt 16 to straighten. When the engine RPM decreases, the oil pressure and the pressure in cylinder 58 decreases, allowing the tension in the belt to force shaft 56 back, allowing spring 40 to rotate tensioner 30 CCW to restore the bends in the left side of the belt.

OPERATION

Preferred Embodiment at Advanced Condition (High RPM)

FIGS. 1 to 5

Assume that the previously described mechanical timing components of the engine are running at high RPM as shown in FIG. 2. Crankshaft 12 is rotating CW, causing belts 14 and 16 to rotate exhaust and intake sprockets 18 and 24, which in turn cause exhaust camshafts 20 and 26 to rotate CW. Lobes 22 and 28 on these camshafts cause the exhaust and intake rocker arms (not shown) to see-saw up and down, opening and closing the exhaust and intakes valves of the cylinders at the proper times in well-known fashion. Intake camshaft 26 thus rotates with and has a fixed angular relation to crankshaft 12.

High oil pressure in the engine causes cylinder 58 to force arm 48 to rotate CW around pivot 50. Idler wheel 44 has moved to the right, forcing the right side of belt 16 into a new, bowed-out configuration. Spring 40 has been extended, allowing tensioner bracket 32 to rotate CW, yet still maintain tension on belt 16.

In its new configuration, belt 16 causes intake sprocket wheel 24 and thus intake camshaft 26 to advance or rotate an additional amount CW, relative to the position of crankshaft 12. Thus the angular relationship between intake and exhaust camshafts 26 and 20 has changed. The angular relation between crankshaft 12 and exhaust camshaft 20 remains unchanged, however.

As stated, FIGS. 1 and 3 show the system at idle where lobes 22 and 28 on camshafts 20 and 26, respectively, are positioned to cause zero overlap between the open states of the intake and exhaust valves, as will be discussed infra. I.e., the continuously variable valve device is in the fully retarded position where the open state of the intake valves is retarded with respect to that of the exhaust valves, i.e. the open states of the intake and exhaust valves do not overlap.

At high speed (FIG. 2), the angular relationship between camshafts 20 and 26 causes overlap of the openings of the associated intake and exhaust valves. I.e., the open state of the intake valves is advanced with respect to that of the exhaust valves, i.e. the open states of the intake and exhaust valves overlap slightly.

At intermediate engine speeds (not shown), the oil pressure in the engine assumes an intermediate value. In turn, cylinder 58 exerts an intermediate force on arm 48, causing an intermediate change in the overlap angle. The mechanical components are arranged so that engine operation is optimized at all speeds.

Timing Diagrams

Figure 4:
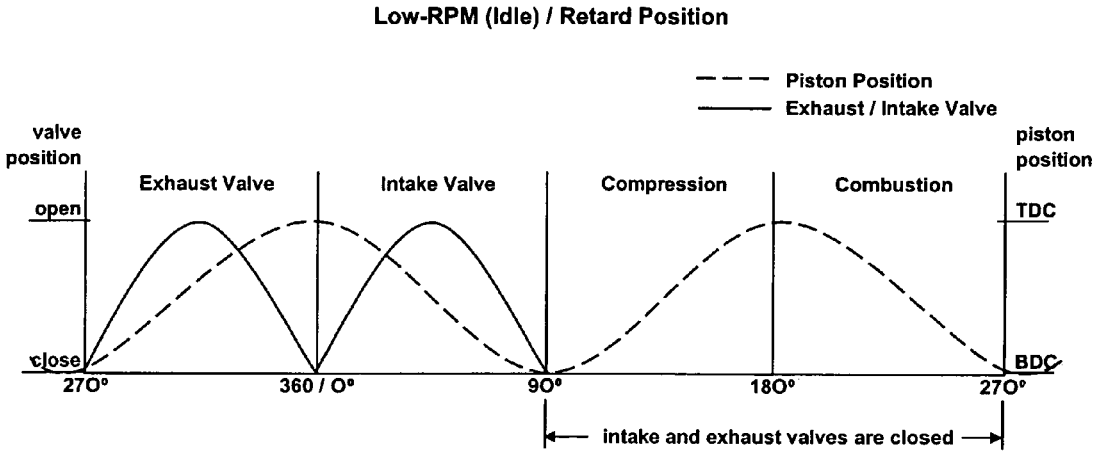
FIG. 4 is a plot showing intake and exhaust valve positions relative to piston position with the inventive device in the retard position.
Figure 5:
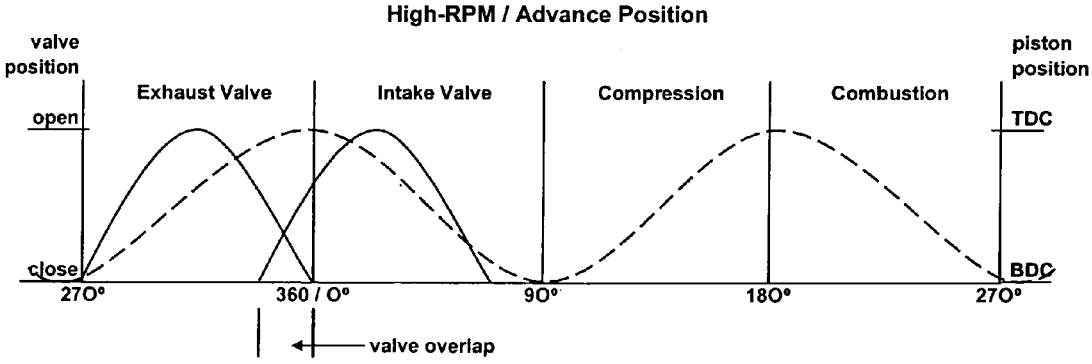
FIG. 5 is a plot similar to FIG. 4, with the device in the advance position.

FIGS. 4 and 5

FIGS. 4 and 5 show the relationship between piston position and valve openings at low and high engine speeds, respectively.

At idle (FIG. 4) the system is in the retard position because the intake valve opens after the exhaust valve is fully closed, as indicated in the first and second sections (from left to right) of FIG. 4.

Specifically, the first section, labeled Exhaust Valve, extends from 270° to 0° or 360°. During this interval, the crankshaft causes the piston, whose position is indicated by the broken line, to move upwardly from an instantaneously stopped position at the lowest point in the cylinder (called BDC for Bottom Dead Center). The piston moves upwardly to its highest point in the cylinder where it also stops instantaneously (called TDC for Top Dead Center). During this interval the exhaust valve, indicated by the solid line, moves from closed to open and then closed again. While the valve is open, the piston's upward movement forces out the gases produced by combustion. The intake valve is closed during this time. As a result, there is no overlap between the opening of the exhaust and intake valves, so that exhaust gases are kept separate from the intake air for more stable combustion. I.e., the intake valve's opening is fully retarded with respect to the exhaust valve. The engine will thus have a smooth idle and good low-RPM torque.

In the second section of FIG. 4, labeled Intake Valve, from 0° or 360° to 90°, the crankshaft causes the piston to reverse direction and move down from TDC to BDC and the intake valve moves from closed to open and back to closed again, as indicated. The open intake port allows the piston's downward movement to draw in the fuel-air mixture. During this intake stroke the exhaust valve is closed, so again there is no overlap between the opening of the intake and exhaust valves and the gases are kept separate for more stable combustion.

During the next and third section of FIG. 4, from 90° to 180° (compression stroke) the crankshaft causes the piston to reverse direction again and rise from BDC to TDC to compress the gas-air mixture. At or near TDC the spark plug is fired, igniting the compressed fuel-air mixture, i.e., ignition occurs. Both valves remain closed.

During the last and fourth section of FIG. 4, from 180° to 270°, the ignited fuel-air mixture combusts rapidly (explodes), forcing the piston down from TDC to BDC. Both valves remain closed during this ignition or power stroke.

At high speeds (FIG. 5), the higher oil pressure causes the timing belt to advance the open time of the intake valve. This is shown in the first section of FIG. 5. Note that the intake valve starts to open before the exhaust valve is fully closed. As a result there is an overlap between the open times of the exhaust and intake valves. This allows excellent engine breathing (better passage of pre-combustion or post-combustion components) and thus better performance at high RPM.

In the second section of FIG. 5, the exhaust valve remains closed and the intake valve continues to open and then closes before the piston moves to BDC.

In the third and fourth sections both valves remain closed, as with the low-speed operation of FIG. 4.

As discussed above, at intermediate speeds, valve overlap assumes an intermediate value related to engine speed. The result is optimal engine performance at all speeds.

DESCRIPTION AND OPERATION

First Alternative Embodiment

FIG. 6

Figure 6:
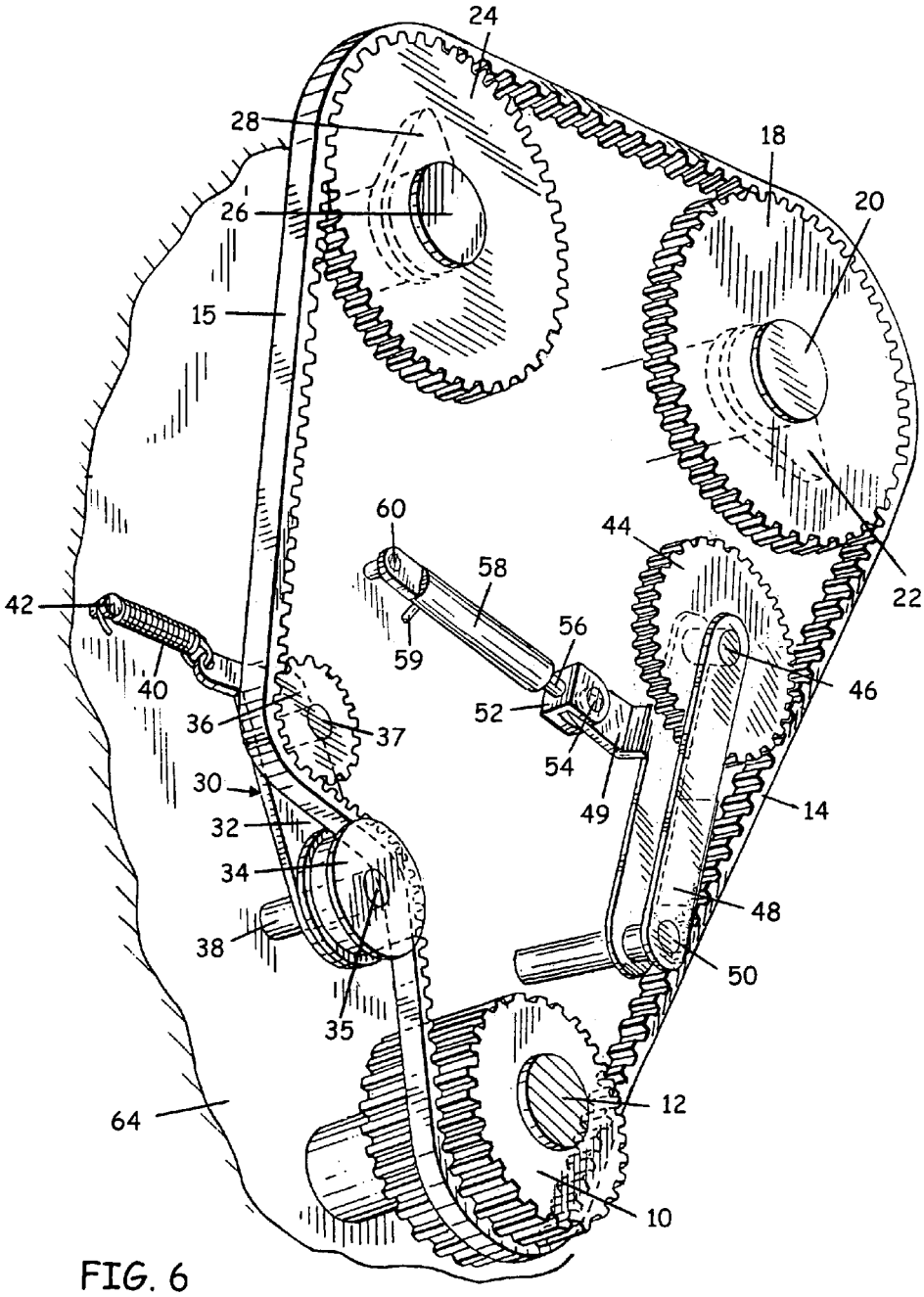
FIG. 6 shows a variation of the preferred embodiment using a single timing belt.

FIG. 6 shows a first alternative embodiment in which only one timing belt 15 is used to drive intake and exhaust sprocket wheels 24 and 18. Belt 15 is shown in its low-RPM condition. As crankshaft 12 rotates, its single sprocket wheel 10 drives belt 15, which in turn drives both intake and exhaust sprocket wheels 24 and 18. Tensioner 30 is attached to belt 15 in the same way it is attached to chain 16 of FIG. 1. Cylinder 58 and its belt-adjusting sprocket wheel 44, however, are repositioned between crankshaft sprocket wheel 10 and exhaust sprocket wheel 18. Belt 15 extends over intake wheel 24, over exhaust wheel 18, over belt-adjusting wheel 44, around crankshaft sprocket wheel 10, and through tensioner 30. Wheel 44 is attached to on one end of arm 48 and the other end of arm 48 is pivoted on pivot 50 so that when piston 56 extends out further from the position shown, it will cause arm 48 to rotate about pivot 50. This forces sprocket wheel 44 against belt 15 so that belt 15 will deform and bend outwardly (not shown). Cams 28 and 22 are arranged so that the open times of the intake and exhaust valves do not overlap, as shown in FIG. 4.

At high engine speeds, the oil pressure in tube 59 increases, forcing piston 56 out of cylinder 58, in turn forcing support arm 48 to rotate CW and causing sprocket wheel 44 to move to the right. This causes belt 15 to bow out to the right, not shown in FIG. 6 but similar to the showing in FIG. 2. The increased tension in belt 15 causes its bends around the wheels in tensioner 30 to straighten. This causes the phase of intake sprocket wheel 24 and exhaust sprocket wheel 18 to change so that sprocket wheels 24 and 18 rotate further CW. This advances the timing of both the intake and exhaust valves, allowing the aforementioned good high-RPM performance and the exhaust gases to exit more rapidly.

DESCRIPTION AND OPERATION

Second Alternative Embodiment

FIG. 7

FIG. 7 shows a second alternative embodiment where two idler wheels are connected by a linkage with a pivot at its center and which are used to adjust the timing belt. The rest of this embodiment is similar to FIG. 6, so only the belt-adjusting components are shown.

Specifically, the upper end of arm 48' is connected to adjusting sprocket wheel 44 as before, but piston 56 is connected directly to the upper end of arm 48' at its connection to wheel 44. Arm 48' is pivoted at its center on pivot 50 so that arm 48' serves as a see-saw pivot arm. The lower end of arm 48' is connected to a sprocketless idler wheel 45, which is positioned on the side of belt 16 opposite wheel 44. When oil pressure increases due to a higher engine RPM, piston 56 will extend out as before, pushing wheel 44 to the right as before. However since wheel 44 is pivotally connected to wheel 45 by seesaw pivot arm 48', when wheel 44 moves to the right, arm 48' will cause idler wheel 45 to move to the left. As a result, wheels 44 and 45 will cause belt 16 to bow to the right at wheel 44 and to the left at wheel 45, thus effectively shortening the belt and advancing the timing of both the intake and exhaust valves as in FIG. 6, whereby the above-noted advantages will accrue. However since belt 16' extends around idler wheel 45, which pushes the belt in the opposite direction from wheel 44, more deformation of belt 16' will occur for the same amount of travel of piston 56. As a result, the distance by which piston 56 travels for the same amount of belt shortening can be reduced so that the size of cylinder 58 and piston 56 can be reduced, thereby providing a more compact arrangement that can be mounted in a more confined space.

DESCRIPTION AND OPERATION

Third Alternative Embodiment

FIG. 8

In the third alternative embodiment of FIG. 8 two idler wheels connected by a linkage with a pivot at one end are used to adjust the timing belt. The rest of this embodiment is similar to FIG. 7, so only the belt-adjusting components are shown.

Specifically, the upper end of arm 48" is connected to adjusting sprocket wheel 44 and piston 56 is connected directly to the upper end of arm 48" at its connection to wheel 44 as before. Arm 48" is pivoted at its bottom end on pivot 50 so that entire arm 48" pivots on pivot 50. The lower end of arm 48" is connected to fixed sprocketless idler wheel 45, which is positioned on the side of belt 16' opposite wheel 44. When oil pressure increases due to a higher engine RPM, piston 56 will extend out as before, pushing wheel 44 to the right as before. When wheel 44 moves to the right, it will cause belt 16' to bow out to the right, as with the embodiment of FIG. 6. However since the other side of belt 16' is positioned against fixed idler wheel 45, which is slightly below but close to wheel 44, the bowing of belt 16' to the right will cause the belt to bend around wheel 45, causing more deformation of belt 16' for the same amount of travel of piston 56. This will effectively shorten the belt and advance the timing of both the intake and exhaust valves as in FIGS. 6 and 7, whereby the above-noted advantages will accrue. However since belt 16' bends around idler wheel 45, the distance by which piston 56 travels for the same amount of belt shortening can be reduced so that the size of cylinder 58 and piston 56 can be reduced, thereby providing a more compact arrangement that can be mounted in a more confined space.

CONCLUSION, RAMIFICATIONS, AND SCOPE

The present system provides a novel method and apparatus for varying valve position in reciprocating internal combustion engines. The device optimizes valve opening times, by varying the phase angle of the camshaft with respect to the crankshaft. The apparatus is inexpensive and simple, has few moving parts, can be adapted to existing engine designs, provides continuous, precise adjustment of the valve phase angle, is reliable, and occupies little space at one end of the engine.

While the above description contains many specificities, these should not be considered limiting but merely exemplary. Many variations and ramifications are possible. —For example instead of being driven in response to oil pressure, the system can be controlled by electrical signals representative of engine speed and load. Instead of a hydraulic cylinder, another motive source can be used to change the path of the intake belt including a pneumatic cylinder, a stepper motor, a gear motor, a system of pulleys and levers driven by a motive force, or even a manually operated positioner. Instead of varying the position of the intake valve, the exhaust valve position can be changed with respect to the intake valve and piston. Instead of causing the timing belt to bow in response to increasing engine speed, the mechanism can be arranged so that the timing belt is bowed at idle speed and is allowed to straighten at idle speed so as to cause a concomitant advance at high speed. Instead of varying only the intake valve position, both the intake and exhaust valve positions can be changed using two similar mechanisms. Instead of using a sprocket wheel for idler wheel 44 (which bears against the intake belt), a smooth wheel or pulley can be used. Instead of using arm 48 to hold idler wheel 44, this wheel can be mounted on a bearing that is attached directly to shaft 56 of cylinder 58 so that increased oil pressure in response to increasing engine speed will force shaft 56 out of cylinder 58, in turn forcing wheel 44 to bow belt 16 outwardly as before. In the embodiment of FIG. 6, the adjuster including sprocket wheel 44 can be positioned between sprocket wheels 24 and 18 in lieu of between sprocket wheel 18 and crankshaft sprocket wheel 10.

While the present system employs elements which are well known to those skilled in the art of internal combustion engine design, it combines these elements in a novel way which produces a new result not heretofore discovered. Accordingly the scope of this invention should be determined, not by the embodiments illustrated, but by the appended claims and their legal equivalents.

The invention claimed is:

1. A mechanism for continuously varying valve timing in a reciprocating, internal combustion engine having a crankshaft, at least one intake valve controlled by an intake valve camshaft, and at least one exhaust valve controlled by an exhaust valve camshaft, comprising:

a. a crankshaft sprocket wheel connected to said engine's crankshaft, b. a camshaft sprocket wheel connected to one of said engine's valve camshafts, c. a deformable linkage connecting said crankshaft sprocket wheel to said camshaft sprocket wheel so that when said crankshaft rotates it will cause said camshaft to rotate, said deformable linkage extending around said crankshaft sprocket wheel and said camshaft sprocket wheel and having one side or leg that is in tension when said crankshaft rotates and another side or leg that is not intension when said crankshaft rotates, d. a displacement device for displacing a displacement member in response to a change in said engine's speed, e. a lever arm, one location on said lever arm connected to a fixed pivot, f. an idler wheel connected said lever arm at another location spaced from said one location so that said lever arm and said other location on said lever arm can pivot with respect to said one location, g. said displacement member being connected to a location on said lever arm spaced from said one location so that said displacement member will displace said lever arm and hence said idler wheel in response to said change in said engine's speed, h. said idler wheel arranged to engage said one side or leg of said deformable linkage so as to change the shape of said deformable linkage and cause the angular orientation of said one of said engine's valve camshafts to change with respect to said crankshaft in response to said change in said displacement of said idler wheel and said engine's speed, and i. a tensioner for maintaining tension in said deformable linkage, whereby the relative angular positions of said crankshaft and camshaft sprocket wheels will change in response to changes in said engine's speed and the timing of the opening of said intake and exhaust valves can be more optimized for a range of engine speeds.

2. The mechanism of claim 1 wherein said deformable linkage is selected from the group consisting of belts and chains.

3. The mechanism of claim 2 wherein said belt or chain has teeth or spaces on one side thereof and said first idler wheel has teeth for mating with said teeth or spaces on said belt or chain.

4. The mechanism of claim 1, further including a second idler wheel, said second idler wheel connected to said lever arm at a location spaced from said fixed pivot and on a side of said lever arm opposite the location where said first-named idler wheel is connected, said first-named idler wheel and said second idler wheel being spaced apart along said belt or chain and mounted on and engaging respective opposite sides of one section of said belt or chain, said second idler wheel being positioned so that when said displacement member displaces said first-named idler wheel in response to said change in said engine's speed, said first-named idler wheel and said second idler wheel will pivot with respect to said fixed pivot and displace said section of said belt or chain in respective opposite directions at different places thereon.

5. The mechanism of claim 1, further including a second idler wheel connected to said fixed pivot, said first-named idler wheel and said second idler wheel being spaced apart along said belt or chain and mounted on and engaging respective opposite sides of one section of said belt or chain, said second idler wheel being positioned so that when said displacement member displaces said first-named idler wheel in response to said change in said engine's speed, said first-named idler wheel will pivot with respect to said second idler wheel and displace said belt or chain with respect to said second idler wheel.

6. The mechanism of claim 1 wherein said displacement device comprises a cylinder and piston, said cylinder connected to oil in said engine so that the position of said piston is responsive to the speed of said engine, and so that said piston forces said idler wheel against said linkage, thereby deforming said linkage in proportion to said speed of said engine.

7. The mechanism of claim 1 wherein said linkage is selected from the group consisting of belts and chains and said idler wheel is a sprocket wheel.

8. The mechanism of claim 1 wherein said camshaft sprocket wheel is connected to said engine's intake valve camshaft, said deformable linkage is selected from the group consisting of belts and chains, said displacement device is arranged to cause said deformable linkage to bow in response to in increase in said engine's speed.

9. The mechanism of claim 8 wherein said displacement device comprises a cylinder and piston, said cylinder connected to oil in said engine so that the position of said piston is responsive to the speed of said engine, and so that said piston forces said idler wheel against said linkage, thereby deforming said linkage in proportion to said speed of said engine.

10. The mechanism of claim 1 wherein said engine has a second sprocket wheel camshaft connected to the other of said engine's valve camshafts as to provide intake and exhaust camshaft sprocket wheels, and wherein said deformable linkage extends around said crankshaft, said intake camshaft sprocket wheel, and said exhaust camshaft sprocket wheel.

11. The mechanism of claim 1 wherein said idler wheel is arranged to engage said one side or leg only of said deformable linkage.

12. A method for continuously varying valve timing in a reciprocating, internal combustion engine having a crankshaft, at least one intake valve controlled by an intake valve camshaft, and at least one exhaust valve controlled by an exhaust valve camshaft, comprising:

a. providing a crankshaft sprocket wheel connected to said engine's crankshaft, b. providing a camshaft sprocket wheel connected to one of said engine's intake valve and exhaust valve camshafts, c. providing a deformable linkage connecting said crankshaft and camshaft sprocket wheels so that when said crankshaft rotates it will cause said one camshaft to rotate, said deformable linkage extending around said crankshaft sprocket wheel and said one camshaft sprocket wheel and having one side or leg that is in tension when said crankshaft rotates and another side or leg that is not intension when said crankshaft rotates, d. providing a tensioner for maintaining tension in said deformable linkage, e. providing a lever arm, one location on said lever arm connected to a fixed pivot, f. providing an idler wheel connected to another location on said lever arm spaced from said one location so that said other location on said lever arm can rotate with respect to said one location, said idler wheel arranged to engage one side or leg of said deformable linkage, g. causing said idler wheel to translate and deform said one side or leg of said deformable linkage in response to a change in said engine's speed so as to change the angular relation between said crankshaft and said one camshaft in response to changes in said engine's speed, whereby the relative angular positions of said crankshaft sprocket wheel and said one camshaft sprocket wheel will change in response to changes in said engine's speed and the timing of the opening of said intake and exhaust valves can be more optimized for a range of engine speeds.

13. The method of claim 12 wherein said deformable linkage is selected from the group consisting of belts and chains.

14. The method of claim 12, further including a second idler wheel, said first-named idler wheel and said second idler wheel being spaced apart along said belt or chain and mounted on respective opposite sides of one section of said belt or chain, said second idler wheel being positioned so that when said first idler wheel is displaced in response to said change in said engine's speed, said first idler wheel will cause said belt or chain to displace with respect to said second idler wheel.

15. The method of claim 14 wherein said first and said second idler wheels are connected at spaced locations on said lever arm so that when said first-named idler wheel translates in response to said change in said engine's speed, said first-named idler wheel and said second idler wheel will push said belt or chain in respective opposite directions at different places thereon.

16. The method of claim 15 wherein said second idler wheel is fixed.

17. The method of claim 12, further including a second idler wheel, said second idler wheel connected to said lever arm at a location spaced from said fixed pivot and on a side of said lever arm opposite the location where said first-named idler wheel is connected, said first-named idler wheel and said second idler wheel being spaced apart along said belt or chain and mounted on and engaging respective opposite sides of one section of said belt or chain, said second idler wheel being positioned so that when said displacement member displaces said first-named idler wheel in response to said change in said engine's speed, said first-named idler wheel and said second idler wheel will pivot with respect to said fixed pivot and displace said belt or chain in respective opposite directions at different places thereon.

18. The method of claim 17 wherein said displacement device comprises a cylinder and piston, said cylinder connected to oil in said engine so that the position of said piston is responsive to the speed of said engine, and so that said piston forces said idler wheel against said linkage, thereby deforming said linkage in proportion to said speed of said engine.

19. The method of claim 12, further including a second idler wheel, said second idler wheel connected to said lever arm at a location spaced from said fixed pivot and on a side of said lever arm opposite the location where said first-named idler wheel is connected, said first-named idler wheel and said second idler wheel being spaced apart along said belt or chain and mounted on and engaging respective opposite sides of one section of said belt or chain, said second idler wheel being positioned so that when said displacement member displaces said first-named idler wheel in response to said change in said engine's speed, said first-named idler wheel and said second idler wheel will rotate with respect to said fixed pivot and displace said belt or chain in respective opposite directions at different places thereon.

20. The method of claim 19 wherein said camshaft sprocket wheel is connected to said engine's intake valve camshaft, said deformable linkage is selected from the group consisting of belts and chains, said displacement device is arranged to cause said deformable linkage to bow in response to in increase in said engine's speed.

21. The method of claim 20 wherein said idler wheel is caused to translate with a displacement device comprising a cylinder and piston, said cylinder connected to oil in said engine so that the position of said piston is responsive to the speed of said engine, and so that said piston forces said idler wheel against said linkage, thereby deforming said linkage in proportion to said speed of said engine.

22. The method of claim 12, further including a second camshaft sprocket wheel connected to the other of said camshafts so as to provide intake and exhaust camshaft sprocket wheels, and wherein said deformable linkage extends around said crankshaft, said intake camshaft sprocket wheel, and said second camshaft sprocket wheel, and wherein said idler wheel is arranged to engage said one side or leg only of said deformable linkage.

23. An apparatus for continuously varying valve timing in a reciprocating, internal combustion engine having a crankshaft, at least one intake valve controlled by an intake valve camshaft, and at least one exhaust valve controlled by an exhaust valve camshaft, comprising:

a. a crankshaft sprocket wheel connected to said engine's crankshaft, b. a camshaft sprocket wheel connected to one of said engine's valve camshafts, c. a deformable linkage connecting said crankshaft and camshaft sprocket wheels, said deformable linkage arranged to change the angular position of said one of said engine's valve camshafts in response to said change in said engine's speed, said deformable linkage extending around said crankshaft sprocket wheel and said camshaft sprocket wheel and having one side or leg that is in tension when said crankshaft rotates and another side or leg that is not in tension when said crankshaft rotates, d. tensioner means for maintaining tension in said deformable linkage, e. a pivot arm having one location thereon connected to a fixed pivot so that said pivot arm can rotate with respect to said fixed pivot, f. displacement means arranged to pivot said pivot arm in response to a change in said engine's speed, g. engagement means on another location on said pivot arm for engaging and deforming said deformable linkage so as to change said angular position of said one of said engine's valve camshafts in response to rotation of said pivot arm by said displacement means, whereby the relative angular positions of said crankshaft and camshaft sprocket wheels changes in response to changes said engine's speed and the timing of the opening of said intake and exhaust valves will be more optimal for a range of engine speeds.

24. The apparatus of claim 23 wherein said deformable linkage is selected from the group consisting of belts and chains and said engagement means is an idler wheel.

25. The apparatus of claim 23 wherein said deformable linkage comprises a first idler wheel, and further including a second idler wheel, said first idler wheel and said second idler wheel being spaced apart along said pivot arm and mounted on respective opposite sides of a section of said belt or chain, said second idler wheel being positioned so that when said displacement member displaces said pivot arm in response to said change in said engine's speed, said first idler wheel will cause said belt or chain to bend with respect to said second idler wheel.

26. The apparatus of claim 25 wherein said pivot arm is arranged so that when said displacement member displaces said first idler wheel in response to said change in said engine's speed, said first-named idler wheel and said second idler wheel will push said belt or chain in respective opposite directions at different places thereon.

27. The apparatus of claim 26 wherein said second idler wheel is fixed.

28. The apparatus of claim 23 wherein said deformable linkage extends around said crankshaft sprocket wheel and said camshaft sprocket wheel, and wherein said engagement means is arranged to engage said one side or leg only of said deformable linkage.

29. The apparatus of claim 23 wherein said displacement means comprises a cylinder and piston, said cylinder connected to oil in said engine so that the position of said piston is responsive to the speed of said engine, and so that said piston rotates said pivot arm and forces said engagement means against said deformable linkage, thereby deforming said deformable linkage in response to speed changes of said engine.

30. The apparatus of claim 23 wherein said deformable linkage is selected from the group consisting of belts and chains and said engagement means comprises a sprocket wheel.

31. The apparatus of claim 23 wherein said camshaft sprocket wheel is connected to said engine's intake valve camshaft, said deformable linkage is selected from the group consisting of belts and chains, and said engagement means is arranged to cause said deformable linkage to bow in response to in increase in said engine's speed.

32. The apparatus of claim 23, further including a second camshaft sprocket wheel connected to the other of said engine's camshafts so as to provide intake and exhaust camshaft sprocket wheels, and wherein said deformable linkage extends around said crankshaft, said intake camshaft, and said exhaust camshaft sprocket wheels, and wherein said engagement means is arranged to engage said one side or leg only of said deformable linkage.

* * * * *

UNITED STATES PATENT AND TRADEMARK OFFICE

CERTIFICATE OF CORRECTION

PATENT NO. : 7,228,829 B1
APPLICATION NO. : 11/286231
DATED : June 12, 2007
INVENTOR(S) : George Louie It is certified that error appears in the above-identified patent and that said Letters Patent is hereby corrected as shown below:

Col. 11, line 8, change “intension” to --in tension--.

Signed and Sealed this

Seventh Day of August, 2007

JON W. DUDAS
*Director of the United States Patent and Trademark Office*